United States Patent [19]

Hansen et al.

[11] Patent Number: 5,072,833

[45] Date of Patent: Dec. 17, 1991

[54] METHOD OF COLLECTING RECYCLABLE MATERIALS

[75] Inventors: David Hansen, West Sand Lake; Patrick F. Mahoney, Rensselear, both of N.Y.

[73] Assignee: EAC Systems, Inc., Albany, N.Y.

[21] Appl. No.: 350,085

[22] Filed: May 10, 1989

[51] Int. Cl.[5] ..... B07C 5/02; B30B 13/00; B65D 30/04

[52] U.S. Cl. ..... 209/3.3; 100/35; 206/459; 209/930; 220/404; 220/908; 383/102; 383/117; 383/127; 414/786

[58] Field of Search ..... 209/3.3, 10, 12, 583, 209/930, 942; 220/1 T, 404, 908, 909; 232/43.1, 43.2, 43.5; 248/95, 97, 99, 100, 101, 542, 907; 312/211, 212; 383/117, 127, 102, 103; 100/35, 229 A; 206/459; 414/786

[56] References Cited

U.S. PATENT DOCUMENTS

| | | | |
|---|---|---|---|
| 652,331 | 6/1900 | Rudolph | 220/404 X |
| 1,372,190 | 3/1921 | Randall et al. | 100/35 X |
| 1,918,793 | 7/1933 | Baker . | |
| 2,257,567 | 9/1941 | Matanovich-Manov et al. | 209/930 X |
| 3,557,685 | 1/1971 | Schroering | 209/930 X |
| 3,595,389 | 7/1971 | Morgan et al. | 209/930 X |
| 3,925,198 | 12/1975 | Eckhoff et al. | 209/141 X |
| 3,934,999 | 1/1976 | Meier . | |
| 4,058.217 | 11/1977 | Vaughan et al. . | |
| 4,077,847 | 3/1978 | Choi et al. | 209/10 X |
| 4,109,571 | 8/1978 | Difley et al. | 100/35 |
| 4,187,775 | 2/1980 | Flender | 209/930 X |
| 4,290,525 | 9/1981 | Sisson . | |
| 4,366,949 | 1/1983 | Staub, Sr. | 383/117 X |
| 4,473,373 | 9/1984 | Weiss | 383/117 X |
| 4,479,581 | 10/1984 | Kelyman. Jr. | 209/3 |
| 4,503,561 | 3/1985 | Bruno | 383/117 X |
| 4,627,783 | 12/1986 | De Filippi | 100/229 A X |
| 4,660,758 | 4/1987 | Tavel et al. | 232/43.2 |
| 4,680,808 | 7/1987 | Paleschuck | 100/229 A X |
| 4,682,699 | 7/1987 | Ertley | 248/907 X |
| 4,743,123 | 5/1988 | Legters et al. . | |
| 4,750,639 | 6/1988 | Schaerer | 206/459 X |
| 4,949,528 | 8/1990 | Palik | 209/930 X |
| 4,995,765 | 2/1991 | Tokuhiro et al. | 209/930 X |

FOREIGN PATENT DOCUMENTS

| | | | |
|---|---|---|---|
| 0652473 | 11/1962 | Canada | 383/117 |
| 3636310 | 4/1988 | Fed. Rep. of Germany | 220/1 T |

*Primary Examiner*—Michael S. Huppert
*Assistant Examiner*—Edward M. Wacyra
*Attorney, Agent, or Firm*—Hoffmann & Baron

[57] ABSTRACT

The present invention concerns a method of collecting recyclable materials and separating recyclable materials from household and commercial refuse for recycling at a recyclable material recovery facility. The method comprises placing recyclable material into a flexible receptacle or container having a rugged construction sufficient to withstand forces experienced under compaction, transfer and dumping, during curbside pick-up, delivery along with mixed solid waste to a delivery point and transferral to a picking station of a solid waste facility. Each flexible receptacle has a predetermined color rendering the flexible receptacle highly visible against and distinguishable from other solid waste. The flexible receptacle is delivered to the delivery point for transferral to a picking station solid waste facility, for the purpose of recycling the recyclable material placed therein. The flexible receptacle is then transferred from the delivery point to the picking station and is then transferred to a material recovery facility, where it is thereafter opened, materials recovered, processed and recycled.

16 Claims, No Drawings

METHOD OF COLLECTING RECYCLABLE MATERIALS

FIELD OF INVENTION

The present relates generally to methods of collecting recyclable materials and apparatus for carrying out the same, and more particularly to methods and apparatus for collecting recyclable materials for recycling at a recyclable material recovery facility.

BACKGROUND OF INVENTION

Ever increasing quantities of solid waste are generated each day which presents a major collection and disposal nuisance as well as serious environmental problems. The cost of disposal of solid waste ranks amongst the costs for public schooling, highways and other general municipal expenses.

Accordingly, as society realizes that its past practices of waste disposal are contaminating its water supplies, beaches and environment in general, new solutions for waste reduction and management are becoming essential.

Regardless of a particular approach to providing solutions for waste reduction and management, there are several fundamental facts regarding the nature of waste, which should be considered in developing new practices for waste disposal. For example, some wastes such as solid organic waste can be recovered and reused or recovered and converted to energy, whereas other wastes, such as plastics, glass, metal and paper can be recovered and recycled for new uses. Such recovery and recycling typically involves processing such wastes into high grade commodities, at a materials recycling or recovery facility In general, the materials recovery facility (MRF) is a processing center where recyclables are separated and processed to maximize value and reusability.

There are on the other hand, other wastes which can be organically composted and used for landscaping or agriculture. Also, a large percentage of our waste cannot be recovered or recycled and is best processed and safely burned to generate energy and usable byproducts.

Examples of waste recovery operations are described in U.S. Pat. Nos. 4,077,847 to Choi et al.; U.S. Pat. No. 3,925,198 to Eckhoff et al.; and U.S. Pat. No. 4,479,581 to Kelyman, Jr.

Conventional methods of disposal such as landfill are becoming prohibitively expensive and are creating serious pollution problems Recovery and processing of recyclable material is becoming essential to our society's waste reduction and management practices.

The benefits of recycling solid waste material are unquestionable. Use of recyclable materials saves considerable energy and natural resources when compared with production of goods from materials materials. Communities participating in recycling programs share in the revenues from the sale of the recyclable materials and realize a net reduction in their solid waste disposal costs. By shredding solid organic waste, and removing ferrous metals therefrom using magnetic-based separation technology, processed refuse fuel (PRF) can be produced from solid organic waste and can thereafter be converted into electrical power (e.g. by burning in a PRF fired boiler), and sold to electric companies, thereby providing additional revenues. In addition, ferrous metals recovered from shredded solid organic waste, for example, can be sold, providing increased waste reduction and additional revenues to offset costs of disposal In short, there are numerous incentives for residents in a particular community, to want to participate in a recyclable materials recovery and recycling program.

It has been reliably estimated that 30–70% of the solid waste stream is recoverable, and that MRF's are capable of reducing the amount of solid waste to be disposed of by as much as 25%.

As with other waste disposal practices, prior art recycling and reprocessing programs have not been without problems.

Specifically, in order for any recycling program to be effective and gain wide community support, it must be convenient to participants and cost effective.

The standard programs presently being promoted require special collection bins or collection containers and separate pick up of recyclable solid waste. These programs often translate into high costs and inconvenience to residents. An original commitment to recycling weakens over time as one is required to separate as many as seven items, each requiring a separate container. The effort required is time consuming and space consuming and only appears to be successful in affluent suburbs.

In addition to requiring special collection bins, containers and separate pick up, prior art recyclable material collection programs and methodologies have been accompanied by other shortcomings and drawbacks as well.

For example, such prior art collection programs require each resident to segregate different types of recyclable materials into distinct types, such as plastics, glass, metal and paper. Consequently, this requirement burdens the community participants with inconvenience and tends to reduce the level of participation.

Also, prior art recyclable material collection programs typically require special equipment and/or additional manpower to handle the pick up of recyclable materials that have been placed in the special collection bins or containers. Notably, as a further inconvenience, the placement of these special collection bins within the community, is usually at centrally located buildings, such as near schools, public dumps, supermarkets, shopping centers and other places remote from the majority of residents who are required to use them.

There are also other types of prior art recyclable material collection programs which use separate collection bins, e.g. "Blue Bins" or Boxes, that are set out along curbside on special pickup days, and which are picked up separately from other household and/or commercial solid waste, using specially designed collection vehicles, typically supported by additional trucks and trailers to pick-up and transfer recyclables. Notably however, such programs which require separate curbside collection with rigid set-out collection bins, may suffer from numerous shortcomings and drawbacks. For example, such prior art recyclable collection programs require that consumers segregate recyclable materials from other solid waste materials which are collected by preexisting solid waste collection systems. Thus, such prior art programs require separate curbside pick-up or collection operations, necessitating separate and additional trucks, collection vehicles, and trailers to pick-up recyclables, which result in enormous labor and transportation costs above the costs of current solid waste collection systems. Moreover, in addition to being generally inefficient, the costs involved in establishing such prior art recycling programs which rely on separate curbside collection with set-out bins, may be equally as enormous as the additional labor and transportation costs of such programs. These separation and collection costs are significantly greater than the value of the materials recovered and therefore large public subsidies are required to make these programs work.

In general, these prior art methods for collecting recyclable materials require extensive supervision, and equipment maintenance, and such prior art collection programs suffer from other drawbacks as well. For example, the special collection bins or containers required by such prior art recyclable material collection programs, are often stolen and the recyclable material placed therein is typically spilled onto the streets and the lawns of the community.

In short, prior art programs for collecting recyclable material involve costly and separate collection of recyclable materials and therefore discourage high levels of participation among residents of the communities who have been asked to participate in such programs. As a result, such recyclable collection programs have been for the most part, unsuccessful in carrying out sought after solid waste recovery and processing goals.

Accordingly, there is great need for improved methods of and apparatus for collecting recyclable materials, for subsequent recycling at recyclable material recovery facilities. Therefore, it is the primary object of the present invention to provide a novel alternative to prior art methodologies for collecting recyclable materials, and also, solid waste collection programs based thereon.

It is a further object of the present invention to provide apparatus useful in carrying out the method of the present invention. In particular, a lightweight flexible receptacle is provided, having a rugged construction sufficient to withstand the forces experienced during curbside pick-up, compaction, transfer and dumping operations. The flexible receptacle is designed for residents to place all unsegregated recyclable materials thereinto, and to then set the flexible receptacle at the curbside with other bagged trash, for collection by public or private collection trucks. Alternatively, the filled flexible receptacle can be dropped into collection containers at a local landfill or transfer station.

It is a further object of the present invention to provide such a flexible receptacle in the form of a bag made of a lightweight, durable, fully recyclable, woven plastic and having a bright color for example orange, which may bear a source identification code on the exterior surfaces thereof for identifying the source of the recyclable material placed in the flexible bag.

A further object of the present invention is to provide a method of collecting recyclable materials for recycling at a recyclable material recovery facility, wherein each flexible receptacle could be individually weighed, the weight thereof recorded, and a source identification code read to identify the source of recyclable material placed in each flexible receptacle. By this process, the identified source, i.e., the community from which the measured recyclable material was collected, could be given credit in an accounting subsystem maintained in the material recovery and processing system.

It is a further object of the present invention to provide such flexible receptacles in the form of plastic bags, which are made from a fully recyclable woven plastic. Such bags have shown a plus 95% bag survival rate in testing under the actual conditions using compactor-type refuse collection trucks.

A further object of the present invention is to provide other apparatus for carrying out the method of the present invention.

These and other objects of the present invention will be explained hereinafter, and will be more particularly delineated in the claims, and other objects of the present invention will hereinafter be apparent to those with ordinary skill in the art to which the present invention pertains.

SUMMARY OF THE PRESENT INVENTION

The present invention concerns a method of collecting recyclable materials for recycling and delivering the material to a recyclable material recovery facility. The method comprises placing recyclable material into a flexible receptacle or container having a rugged construction sufficient to withstand forces experienced under compaction, transfer and dumping during, for example, curbside pick-up, delivery to a delivery point and/or a picking station of a solid waste facility, and subsequently transferred to recyclable material recovery facility. Each flexible receptacle has a visually detectable means on the exterior thereof, for rendering the flexible receptacle highly visible against and distinguishable from other solid waste in the solid waste stream. Each flexible receptacle may bear a source identification means, e.g., source code or indicia, on the exterior of the flexible receptacle. This source indicia could serve to identify the source of the recyclable material placed in the flexible receptacle and to provide instructions as to its correct usage.

In the preferred embodiment, the flexible receptacle is deposited at curbside along with other household commercial or other solid waste. The flexible receptacle is then picked up along with other household, commercial and other solid waste, and placed in a collection truck participating in a curbside waste collection system. The flexible receptacle is delivered from curbside to the delivery point at a solid waste facility, removed from the waste stream at the solid waste facility and then transferred to a material recovery facility, where it is thereafter processed and the materials therein sorted into recyclable components which are to be recycled.

In the preferred embodiment the receptacles are weighed at the MRF. However, the removed flexible receptacles may be placed on a conveyor at the picking station of a solid waste facility (SWF) and then transferred to a measuring and recording station at which the weight of each flexible receptacle could be individually measured, and the weight thereof recorded. The source identification means, e.g. code, on the exterior of each flexible receptacle could be read, or otherwise recognized, in order to identify the source of the recyclable material placed in the flexible receptacle. On the basis of the read source (e.g., community) identification code and recorded weight, each identified source could be accredited with the measured weight of recyclable material placed into each flexible receptacle. After the collected waste accrediting step, the recyclable material from each flexible receptacle is transported to a recyclable material recovery facility (MRF), emptied, and is subsequently processed at such facility.

Preferably, the flexible receptacles are realized in the form of fully recyclable bags, which can also be recycled after having been emptied of recyclable materials at, for example, the recyclable material recovery facility.

As a result of the present invention, it is now possible to provide a highly convenient method and apparatus for recyclable material collection, which allows participants to co-mingle all recyclable materials together. Residents will save the time of separating several types of recyclable materials into separate containers and the space required to store recycled materials in the home would be significantly reduced. The flexible receptacles can be used in apartment buildings or public housing to serve more than one dwelling unit, or be stored in a hallway and thus increase recycling participation in urban areas.

A primary advantage of the method of the present invention is that additional trucks, collection vehicles, and trailers are not necessary, and existing labor and transportation costs remain the same.

Also, the cost savings that a community will experience over traditional recycling programs, will remove one of the greatest barriers to municipal recycling.

In addition, the method, preferably relying on preexisting curbside collection programs using public or private compactor-type collection trucks, is convenient for consumers, will potentially increase participation rates, and provides an attractive alternative to the separate collection of recyclable materials in a particular community, and thereby avoids the shortcomings and drawbacks of prior art collection methodologies as discussed hereinbefore

DETAILED DESCRIPTION OF THE PREFERRED EMBODIMENT

The preferred embodiment of the method of collecting recyclable materials will be described as follows.

In order to collect recyclable materials such as metal bottles, cans, plastic cups, bottles, packages, glass containers, bottles, jars and paper products such as newspapers, magazines, books and the like a recyclable material collection bag is used.

In order that the recyclable material collection bag possesses a rugged construction sufficient to withstand forces experienced under pick-up, compaction, transfer, and dumping operations, the bag should have physical characteristics and properties so that (i) it will not tend to tear if it is punctured; and (ii) that it be sufficiently porous, e.g. air permeable, so that it will not "pop" or burst upon compaction in, for example, a compactor-type refuse collection truck.

In the preferred embodiment, the recyclable material collection bag is formed from a fully recyclable material such as woven polypropylene or other material providing equivalent physical characteristics and can have the dimensions on the order of conventional garbage bags or leaf bags. The woven polypropylene bag comprises a flexible receptacle portion defining a partially enclosed volume and has an opening for insertion of recyclable materials. The recyclable material collection bag, formed from woven polypropylene material, has a sufficiently porous nature and a woven construction During extensive testing and analysis of the bag under actual test conditions, the bag of the present invention has proven to have a rugged construction sufficient to withstand forces experienced under compaction, transfer and dumping operations. In fact, the woven recyclable material collection bag of woven polypropylene construction, has shown in actual testing to have a 95% bag survival rate when used under actual conditions using a compactor-type refuse collection trucks.

Notably, however, other types of materials having other grades of material strength, expectedly can be used to form the recyclable material collection bag of the present invention. However, such recyclable material collection bags should possess the above-described physical characteristics and properties.

In general, the recyclable material collection bag has a visually detectable means for rendering itself highly visible against and distinguishable from other solid waste. In the preferred embodiment, this visually detectable means is realized as a highly visible predetermined color scheme. In particular, a predetermined color scheme that has been discovered to be highly effective in carrying out the objects of the present invention, is a predetermined color, such as bright orange.

However, it is expected that bright green colored bags and bags of fluorescent orange, pink or yellow/-green color can also be used with good results as such colored bags are easily spotted at the picking station of a solid waste facility.

In order to identify the source of the recyclable material placed in the recyclable material collection bag, the bag could bear or carry a source identification means or coding system, which can be, for example, a sequence of numbers, a bar code, an arrangement of alpha-numerical characters, or other symbols which serve to identify the source of the recyclable material placed in the flexible bag. If provided, the source identification is marked in a contrasting color upon the bright color of the flexible bag, as this particular color scheme has been found to be a highly effective one in carrying out the objects of the present invention. However, according to principles of the present invention, the source identification means could alternatively be a source identification means in the form of a flexible adhesive label or sticker "encoded" so as to identify the source, or community, or municipality from which the bag hereof originated. Preferably, in this embodiment, the encoded adhesive label can be firmly adhered to the bag hereof which has been retrieved from stock inventory of such bags. One advantage of this approach is that the bags in stock can be "source encoded" using the encoded labels corresponding to a particular community, and thereafter distributed (i.e., supplied) thereto, thereby satisfying the requirements of the various communities, according to principles of supply and demand economics, as desired.

An even further embodiment of the source identification means would be to use an "encoded" tag or tie string or device for securely closing the recyclable material bag hereof, which function will be described in greater detail hereinafter. Here, the tie string could have a distinctive color, tag, or physical attribute (e.g., notches formed therein, or coded embossed thereon) which is capable of identifying a particular source or community, as described hereinbefore.

In the preferred embodiment, the source identification means (i.e., source indicia or code) comprises the sequence of repeating characters disposed along the length of the bag. The repeating characters serve to identify the source from which the recyclable material in the bag originates.

Alternatively, however, the source indicia can be for example, a bar code. One advantage of this type of code is that it could be read using, for example, automatic character recognition apparatus known in the art.

In the preferred embodiment, the recyclable material collection bag bears on its external surface, instructional indicia, which can be, for example, written instructions as to how to use the bag within a particular recyclable material collection program being implemented within a particular community. Also the instructions indicate the types of recyclable materials which can be placed inside the recyclable material collection bag, as well as indicate those materials which should not be placed within the bag. Thus by indicating on the recyclable material collection bag "the do's and don'ts" to consumers participating in the recyclable material collection program, the likelihood of success of the program is substantially increased. Notably, whatever materials are indicated as being proper for insertion into the recyclable material collection bag of the present invention, the recyclable materials may be mixed together.

In the preferred embodiment as well, the recyclable material collection bag has an exterior section or "advertising surface" on which advertising or sponsorship materials or other indicia can be printed using techniques known in the modern printing arts. Such advertising or sponsorship materials can relate to those entities (e.g., municipal, commercial or otherwise) which either fund or participate in a particular recyclable material collection program. On the other hand, the advertising surface can be used to advertise the products or services of the collection programs sponsors in general.

In addition, the flexible recyclable material collection bag includes in the preferred embodiment, another exterior section, or "trademark/logo surface" on which a trademark/logo is placed for designating the source of origin of the recyclable material collection receptacle.

The method of the present invention will now be described in detail.

The above-described recyclable material collection bags are manufactured in mass supplies and then distributed by a licensed recyclable material bag supplier or suppliers. To carry out the method of the present invention, there are several ways in which the bags may be distributed. For example, on the one hand, the bags may be distributed by the community participating in a particular recyclable material collection program. The persons who actually distribute them might be, for example, municipal workers On the other hand, the recyclable material bags can be distributed by being offered for sale in retail outlets or otherwise purchased by consumers. The manner in which the bags are distributed however, depends on the structure of the particular recyclable material collection program.

In the case where there is a community distribution of the bags, taxes on members of the community can be used for the purchase and the distribution of the bags. Yet, it is possible that individual consumers who wish to participate in a recycling program, can purchase recyclable material bags having a source identification code on the bag which corresponds specifically to a particular consumer, rather than a particular community. Such an approach would not require that an entire community participate in the collection program, but only rather, willing residents who might be given a tax credit as an incentive for participating in the recycling program.

In the preferred embodiment of the method of the present invention, recyclable material is placed within the recyclable material collection bag. A closure device is used to securely close the opening of the receptacle portion of the bag, so that the closed bag can withstand forces experienced under compaction, transfer, and dumping operations, that is, without breakage and spillage of solid recyclable waste contained therein An example of the closure device can be a sealing device having a ratchet-like tightening mechanism, known in the art, yet, it is expected that other closure systems for example, (i) a tie string, (ii) a string attached to the collection bag, (iii) a nylon-wire tie, separate from the collection bag, or (iv) a draw-string woven into the collection bag, can be used with acceptable results. However, since a closure device is required for each collection bag distributed within any particular collection program, cost factors of the closure device should be considered as well.

The recyclable material collection method of the present invention can be carried out using the system apparatus. For example, once the recyclable material collection bag is filled with recyclable material and securely closed using a closure device, the bag is deposited at curbside along with other household, commercial or other solid waste which is to be picked up by a collection truck participating in a curbside waste collection system. The recyclable material collection bag is then picked up along with other household, commercial or other solid waste, and is placed in collection truck. The collection truck, preferably but not necessarily of a compactor-type, compacts the bags with other picked-up household trash as required, and eventually transfers the compacted bags and other solid household waste to the tipping floor of a solid waste facility. The collected waste in the compacted trucks are then tipped onto the tipping floor and are eventually placed or pushed onto a conveyor of a picking station.

At the picking station, the recyclable material collection bags are easily identified by their bright orange color and/or identifying logo (i.e. visually detectable means), and are removed from the stream of solid trash moving along the conveyor.

To carry out such a "picking operation," the solid waste or functionally equivalent facility must be provided with the capability of efficiently separating out the recyclable material collection bags filled with comingled recyclables, from other trash moving along the solid waste stream. Expectedly, there are a variety of ways in which to achieve this function.

Typically, the bag "picking" or removal operation is carried out by workmen manually picking out the highly-visible recyclable material collection bags from other solid household and commercial waste moving along a "pit" conveyor of the picking station To carry out this manual operation, workmen can utilize a specially developed "picking instrument" This instrument comprises a light-weight shaft (preferably made from aluminum or carbon fiber), and a picking means. The shaft is adapted to be held in a person's hand much like a rake, and includes a picking means having a plurality of claw-like projections with slightly turned-in end projections. The picking instrument also includes a planar, spade-like structure disposed opposite from the claws. Notably, the slightly turned-in projections can be selectively inserted into the interstices of the warp and weft of the woven plastic construction of the flexible bag hereof, so as to allow a grabbing or retention effect to be achieved By slight inward and upward motion of the claws, the bag is easily freed from the picking means. Also, in order to move or push other solid trash away from a visually recognized bag hereof, that is, without retaining or grabbing a flexible bag hereof, the planar structure is employed as a solid waste moving means.

In order to increase the bag recovery rate of bags from the solid waste stream moving along the pit conveyor, an auxiliary picking station is employed. This auxiliary picking station includes an inclined conveyor, receiving bags and other solid waste moving along conveyor, and moving such solid waste to the infeed chute of a solid waste shredder. The auxiliary picking station also includes a manned platform located over the inclined conveyor, although the picking station may also be located along the side of the conveyor. It has been discovered that even when load depth on the infeed conveyor is high, this auxiliary picking station provides improved recognition of bags by workmen, and thus improved bag recovery while utilizing the picking instrument of the present invention.

Alternatively, the operation of picking-out "filled" recyclable material collection bags hereof from the solid waste stream, moving along a conveyor at the solid waste facility, can be carried out using automated means. Such automated means for picking-out bags hereof, would include one or more robotic arms, each having "claws" or grabbing means which, in many respects, are functionally equivalent to the ones on the manually-operated picking instrument. Such grabbing means serve to pick-up and controllably hold onto, and controllably release the flexible bag in response to bag-hold and bag-release signals, respectively. The automated bag picking means would be installed adjacent conveyor system, along which a solid waste stream with "filled" bags intermixed therein, passes, and would be capable of operating over a sufficient extent of the conveyor. The automated bag picking means would include a computer-control system, and a computer-based machine vision system known in the art. The computer control system would control the movements of the robotic arms in response to sensed imagery of the solid waste stream generated by the machine vision system. In particular, the machine vision would recognize the visually detectable means (e.g. the highly visible color and/or distinctive marking) on the exterior of each recyclable material collection bag in the solid waste stream. In response to such visual "bag" detection, the machine vision system generates on a real-time basis, bag-position signals, which for example, would correspond to a bag's position (i.e. X, Y, Z coordinates) along the conveyor at some instant of time, $t_i$. The bag-position signals are provided to the computer-control system, and in response thereto, the computer-control system computes command instructions guiding the robotic arm to pick-out a "recognized" bag of the present invention, and place it, for example, onto another conveyor system designated for the transfer of recyclable material collection bags to the recyclable material recovery facility The release of the bag from the grabbing means is effected in response to presentation of bag-release signals to the computer control system.

Once removed, the bags which have been placed onto another conveyor (not shown) at the solid waste facility may then be transferred to a measuring and recording station. However, instead, such measurement and recording operations can take place at the material recovery facility, or a system of average bag weights using statistics may be employed instead of weighing each bag.

At the measuring and recording (i.e. accounting) station the weight of each bag is individually measured and the weight thereof recorded, or otherwise accounted for. The source identification code on the exterior of each bag is read or otherwise recognized, in order to identify the source, i.e. community, of the recyclable material placed in the bag. On the basis of the read source identification code and recorded weight, each identified community is accredited with the measured weight of recyclable material placed in the recyclable material collection bag. Typically, the accounting of such waste material accredation is carried out using a computer-based information storage and retrieval system well known in the art.

At the recyclable material recovery facility and after the accrediting step of the method hereof, the recyclable material in each bag is emptied and subsequently recycled in a manner known in the art.

The emptied recyclable collection bags are then collected and are thereafter recycled.

It is contemplated that modification to the present invention would involve placing recyclable materials within the recyclable material collection receptacle hereof, and having homeowners deposit the same into designated collection bins located at strategic locations within the local community. Large compactor-type trucks would then deliver the locally-collected, "filled" recyclable material collection receptacles to a material recovery facility (MRF) for subsequent processing as described hereinbefore.

While the particular embodiments shown and described above have been proven to be useful in many applications involving the recyclable material collection arts, further modifications of the present invention herein disclosed will occur to those skilled in the art to which the present invention pertains and all such modifications are deemed to be within the scope and spirit of the present invention defined by the following claims.

What is claimed is:

1. A method of collecting recyclable materials for recovery at a recyclable material recovery facility, said method comprising the steps of:

(a) placing recyclable material into a flexible receptacle having a rugged construction sufficient to withstand forces experienced under compaction even when filled with solid waste materials, said flexible receptacle further having a visually detectable means on the exterior of said flexible receptacle for rendering said flexible receptacle highly visible against and distinguishable from other solid waste;

(b) closing said flexible receptacle so as to prevent said recyclable material from escaping from said flexible receptacle during compaction, transfer and dumping operations;

(c) compacting said flexible receptacle and said recyclable material therein without destroying the integrity of said flexible receptacle; and (d) delivering said flexible receptacle to a delivery point.

2. The method of claim 1, wherein said method further comprises after step (d):

(e) transferring said flexible receptacle from said delivery point to a picking station of a solid waste facility and then separating said flexible receptacle from trash materials at said picking station.

3. The method of claim 1 wherein said method further comprises after step (a), depositing said flexible receptacle at curbside along with other solid waste, picking up said flexible receptacle along with said other solid waste, and placing said flexible receptacle and said other solid waste in a collection truck.

4. The method of claim 3, wherein step (c) comprises, compacting in said collection truck, said flexible receptacle and said other solid waste.

5. The method of claim 4 wherein said flexible receptacle is porous, wherein air is caused to escape from said flexible receptacle during the compacting thereof.

6. The method of claim 1 wherein said flexible receptacle is porous, wherein air is caused to escape from said flexible receptacle during the compacting thereof.

7. The method of claim 1 including the step of emptying said flexible receptacle at said delivery point.

8. The method of claim 1 including the step of encoding said flexible receptacle and the step of detecting the encoded flexible receptacle at said delivery point.

9. A method of collecting recyclable materials, comprising:

providing a plurality of flexible receptacles having rugged constructions sufficient to withstand forces due to compaction within a waste collection vehicle even when filled with solid waste materials;

causing said receptacles to be filled with recyclable solid waste materials;

gathering said filled receptacles;

compacting said filled receptacles without destroying the integrity thereof; and transporting said compacted, filled receptacles to a delivery point.

10. A method as described in claim 9 wherein said filled receptacles are gathered and compacted with other solid waste materials.

11. A method as described in claim 10 including the step of separating said compacted, filled receptacles from said other solid waste materials at said delivery point.

12. A method as described in claim 11 wherein said receptacles are made from a woven, polymeric material, whereby air is caused to escape from said receptacles during the compacting thereof.

13. A method as described in claim 9 wherein said receptacles are made from a woven, polymeric material, whereby air is caused to escape from said receptacles during the compacting thereof.

14. A method as described in claim 9 wherein said receptacles are porous, whereby air is caused to escape from said receptacle during the compacting thereof.

15. A method as described in claim 9 including the step of emptying said compacted, filled receptacles at said delivery point.

16. A method as described in claim 9 including the step of encoding said flexible receptacles and the step of detecting the encoded, compacted, filled receptacles at said delivery point.

* * * * *